US010292486B2

(12) United States Patent
Vecchiola et al.

(10) Patent No.: US 10,292,486 B2
(45) Date of Patent: May 21, 2019

(54) HAIRBRUSH WITH IMPROVED TEMPERATURE CHARACTERISTICS

(71) Applicant: 1682796 Ontario Inc., Toronto (CA)

(72) Inventors: Michael Victor Vecchiola, Toronto (CA); Patricia M. Coyne, Toronto (CA)

(73) Assignee: 1682796 ONTARIO INC., Toronto, Ontario (CA)

( * ) Notice: Subject to any disclaimer, the term of this patent is extended or adjusted under 35 U.S.C. 154(b) by 311 days.

(21) Appl. No.: 15/141,033

(22) Filed: Apr. 28, 2016

(65) Prior Publication Data

US 2017/0035193 A1 Feb. 9, 2017

Related U.S. Application Data

(60) Provisional application No. 62/153,834, filed on Apr. 28, 2015.

(51) Int. Cl.

| | |
|---|---|
| ***A46B 9/02*** | (2006.01) |
| ***A46B 15/00*** | (2006.01) |
| ***A45D 20/52*** | (2006.01) |
| ***A46D 3/00*** | (2006.01) |

(52) U.S. Cl.

CPC ..... *A46B 9/023* (2013.01); *A45D 20/52* (2013.01); *A46B 9/02* (2013.01); *A46B 9/026* (2013.01); *A46B 15/003* (2013.01); *A46B 15/0016* (2013.01); *A46D 3/00* (2013.01); *A46B 2200/104* (2013.01)

(58) Field of Classification Search

CPC .... A46B 3/00; A46B 3/08; A46B 3/10; A46B 3/18; A46B 9/023; A46B 9/026; A46B 9/028; A46B 9/08; A46B 9/12; A46B 15/00; A46B 15/0016; A46B 15/003; A46B 15/0051; A46B 2200/104

USPC ..... 15/159.1, 160, 168, 171, 186, 206; 132/120

See application file for complete search history.

(56) References Cited

U.S. PATENT DOCUMENTS 2,397,757 A * 4/1946 Schwedersky ..... A61N 5/0617 15/105
2,688,971 A * 9/1954 Daniels ..... A45D 20/48 15/105
5,911,226 A * 6/1999 Vecchiola ..... A46B 9/023 132/162

(Continued)

FOREIGN PATENT DOCUMENTS

CA 2 206 690 C 2/2005
CA 2 538 297 A1 8/2006

(Continued)

OTHER PUBLICATIONS

PCT/CA2016/050488 International Search Report, dated Jul. 20, 2016.

*Primary Examiner* — Mark Spisich
(74) *Attorney, Agent, or Firm* — Fay Sharpe LLP

(57) ABSTRACT

A combination of a hairbrush having a brush head with a concave central portion and captive ends, along with a thermal coating that includes a desired amount of at least one of aluminum, silver, and/or diamond dust in the coating, results in a hairbrush that can be raised to approximately 200° F. in a short timeframe. A conventional hairbrush without either the coating or the captive ends was unable to achieve the desired temperature.

10 Claims, 2 Drawing Sheets

(56) References Cited

U.S. PATENT DOCUMENTS

| | | | | |
|---|---|---|---|---|
| D564,762 | S | 3/2008 | Vecchiola | |
| 7,661,174 | B2 | 2/2010 | Park | |
| 2002/0066150 | A1 | 6/2002 | Bigio | |
| 2004/0088812 | A1* | 5/2004 | Weihrauch | A46B 9/023 15/186 |
| 2007/0174984 | A1* | 8/2007 | Diamond | A45D 20/525 15/106 |
| 2008/0201979 | A1* | 8/2008 | Rhoades | A45D 20/10 34/283 |
| 2009/0165234 | A1* | 7/2009 | Bernat Bernat | A46B 3/18 15/160 |
| 2009/0229624 | A1* | 9/2009 | Purvis | A45D 24/16 132/120 |
| 2010/0163067 | A1* | 7/2010 | Wynne | A45D 24/02 132/162 |
| 2010/0200011 | A1* | 8/2010 | Wynne | A46B 7/023 132/120 |
| 2011/0017226 | A1* | 1/2011 | Choi | A45D 20/52 132/120 |
| 2013/0312783 | A1* | 11/2013 | Fiorio | A46B 9/023 132/237 |

FOREIGN PATENT DOCUMENTS

| | | | |
|---|---|---|---|
| CA | 2 578 180 | A1 | 8/2008 |
| DE | 102006061744 | * | 4/2008 |
| GB | 2422535 | * | 8/2006 |

* cited by examiner

HAIRBRUSH WITH IMPROVED TEMPERATURE CHARACTERISTICS

This application claims the priority benefit of U.S. provisional application Ser. No. 62/153,834, filed Apr. 28, 2015, the entire disclosure of which is expressly incorporated herein by reference.

BACKGROUND

The present disclosure relates to hairbrushes, and more particularly to a new hairbrush design having improved temperature characteristics, as well as a method of making same.

Styling hairbrushes are well known. However, a need exists for a hairbrush that is conducive to higher temperature hairdryers used in association with hairstyling. For example, hairdryers in use today operate in a temperature range of approximately 150° F. to 200° F. or greater. When styling more fragile hair, lower air speed and lower temperature are desired. For example, an airspeed of about 25 mph and a temperature of 150° F. would be more commonly used for fragile hair. On the other hand, thicker, more curly hair requires a higher air speed (e.g., about 65 mph) and higher temperature (200° F. or greater) for purposes of shaping.

Conventional styling hairbrushes only reach a temperature of approximately 140°, even after being exposed to high heat for an extended period of time. Therefore, a need exists for the new hairbrush design that can reach close to the optimum temperature of the dryer in a short timeframe.

SUMMARY

A hairbrush includes a handle. A brush head extends from the handle and has an outer surface with openings formed therein. At least the outer surface of the brush head includes a thermally reflective coating applied thereto. Bristles extend through the openings in the outer surface of the brush head.

The reflective coating is formed at least in part of at least one of aluminum, silver, and/or diamond dust.

The brush head includes captive ends at opposite ends of a central portion, the captive ends shaped to direct airflow from an associated hair dryer toward the central portion of the brush head.

The central portion has a concave configuration wherein the outer surface reduces in cross-sectional dimension from each of the captive ends toward a mid-point of the brush head between the captive ends.

A method of making a hairbrush having improved temperature characteristics, includes providing a handle, providing a brush head having a central portion with a concave outer surface, and first and second captive ends at opposite ends of the central portion, coating the brush head with a thermally reflective coating applied thereto, and securing the handle and brush head together.

The coating step includes applying first and second coatings to the brush head.

The coating step includes incorporating at least one of aluminum, silver, and/or diamond dust into the thermally reflective coating.

Benefits and advantages of the present disclosure will become more apparent from reading and understanding the following detailed description.

DETAILED DESCRIPTION

Figure 1:
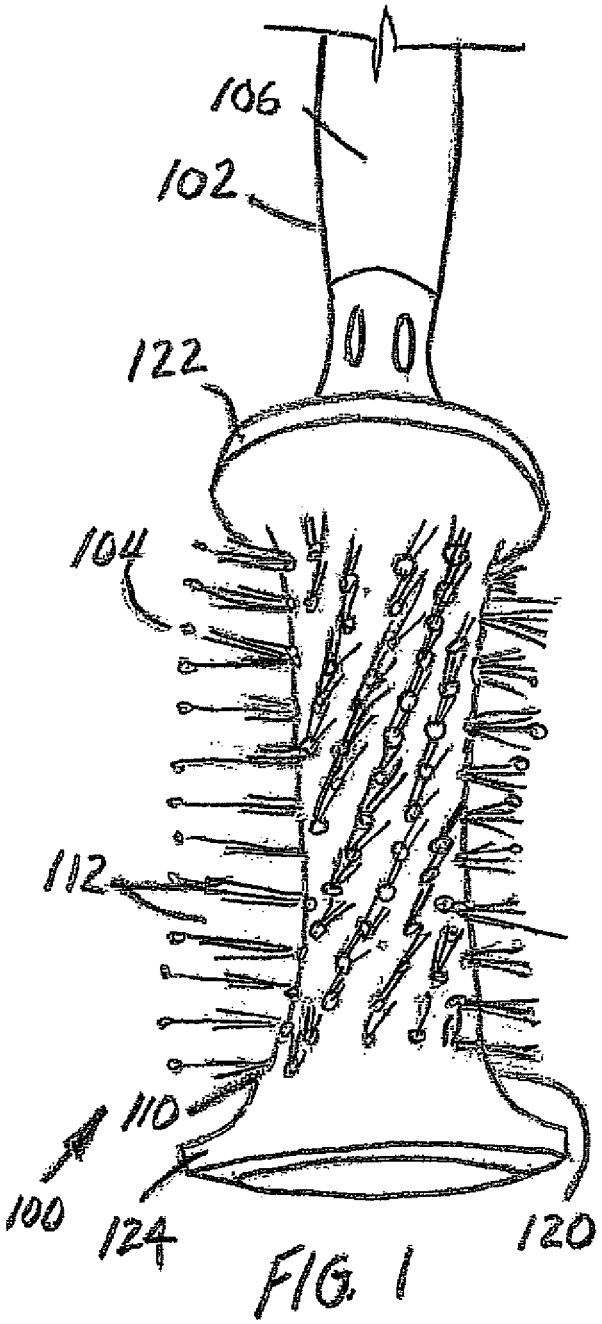
FIG. 1 (PRIOR ART)
FIG. 1 shows a conventional hairbrush.

Turning to FIG. 1, there is shown a conventional hairbrush 100 having a handle 102 that is connected to a brush head 104. The handle 102 preferably includes a soft grip 106 received over at least a portion of the handle. For example, the handle 102 and brush head 104 may be a single, unitary body or structure and the grip 106 received over an elongated, generally cylindrical portion at one end of the body.

A series of openings 110 are provided in the brush head 104 and adapted to receive bristles 112 that extend through the openings. The bristles extend radially outward from the surface of the brush head 104, namely, generally perpendicular to the surface of the brush head. The bristles 112 (e.g., boar/nylon bristles) are shown in circumferentially spaced rows; however, one skilled in the art will appreciate that still other bristle configurations can be used without departing from the scope and intent of the present disclosure.

The brush head 104 includes a concave portion 120 with so-called captive ends 122, 124 formed at opposite ends of the concave portion. The captive ends 122, 124 extend generally radially outward a predetermined height from the concave portion 120. The inner captive end 122 is formed adjacent the grip 106 of the handle 102 (shown in FIG. 1 as being spaced a predetermined dimension from the handle), and the inner captive end 122 generally defines a demarcation between the brush head 104 and the handle. In the conventional hairbrush 100 of FIG. 1, the handle 102 and the brush head 104 are preferably formed from a single, unitary material, e.g. plastic, wood, or metal, while the grip 106 is formed of a different material.

Figure 2:
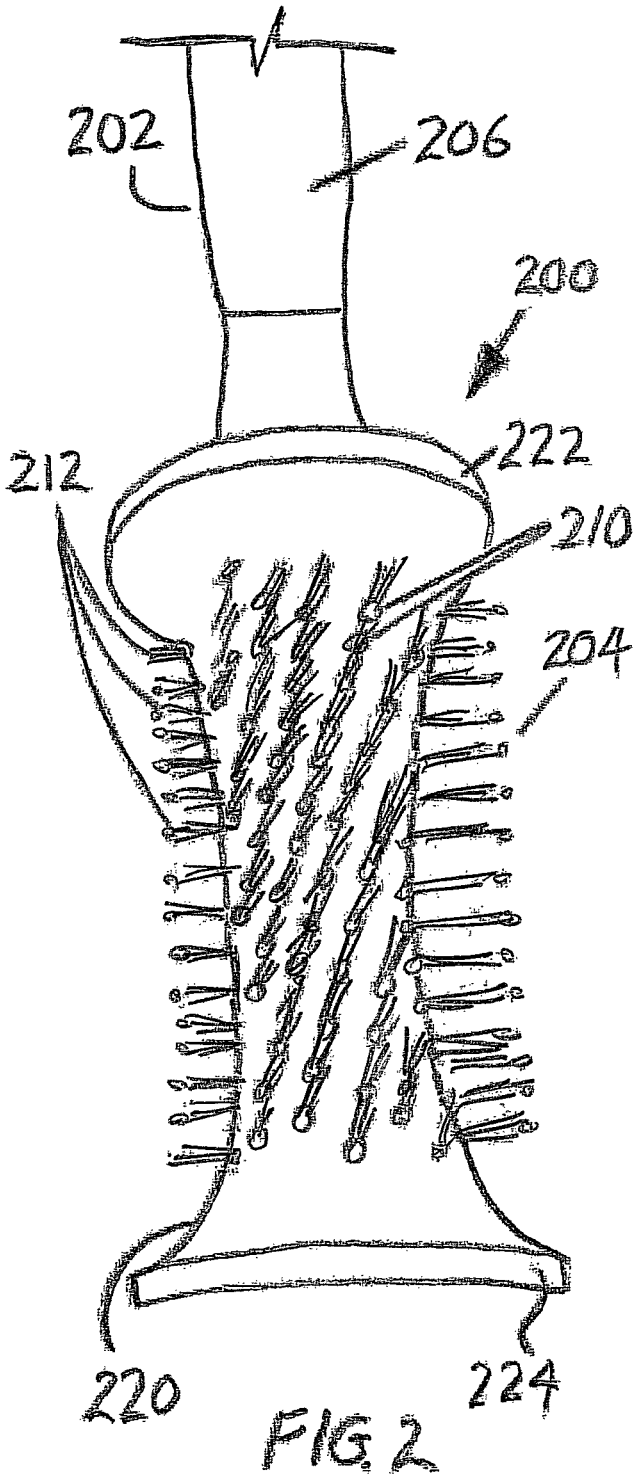
FIG. 2 shows a hairbrush and improved temperature characteristics in accordance with the present disclosure.

Turning to FIG. 2, the subject disclosure illustrates a hairbrush 200 with improved temperature characteristics. For ease of illustration, description, and understanding, like components or portions of the hairbrush 200 shown in FIG. 2 will be referenced in the "200" series, and generally correspond to those components or portions in the "100" series of the hairbrush 100 of FIG. 1 except where specific differences are noted below. Although aluminum has been used as a body of a hairbrush, it is preferred that the body not be formed of aluminum because of the expense and weight. The present disclosure has advantageously determined that by improved thermal characteristics are achieved by applying a metal compound onto the hairbrush body, i.e., using a liquid application that includes a predetermined amount of aluminum as a constituent component. More specifically, the coating that includes aluminum as a constituent component when applied on to a concave brush head 204 having captive ends 222, 224 quickly reached a peak temperature of approximately 200° F. when high velocity air (about 65 mph) from a hairdryer was applied at approximately 200° F. Specifically, the combination of the thermally conductive coating and captive ends configuration allowed the brush head to reach this peak temperature of approximately 200° F. in approximately 18 seconds. This is in contrast, as noted above, to the conventional hairbrush 100 that only reached a temperature of 135° F., even after application of the high velocity airflow and 200° F. for over one minute.

A preferred coating includes proximally 75% acrylic acid polymers, approximately 15% butyl acetate, approximately 10% aluminum paste, and approximate 1% other chemical accessories. This coating has a silver colored appearance. Alternatively, other materials than aluminum paste can be used that serve the same purpose as the aluminum paste, for example, silver and/or diamond dust may be used individually or together, or individually or in various combinations with the aluminum paste, in generally the same total amount of approximately 10% of the coating composition. The captive ends 222, 224 on the hairbrush 200 and the concave portion 220 are also believed to contribute to focusing the heat on the brush head 204 region. Preferably, the only part of the hairbrush 200 that is coated with the liquid is the brush head 204 (concave portion 220, and captive ends 222, 224).

Tests were conducted on the coated, captive end hairbrush illustrated in FIG. 2. For example, a hairdryer was used to direct high velocity air of approximately 200° F. at the surface of the brush head 104 (without captive ends 122, 124). The conventional hairbrush 100 having a concave portion 120 without captive ends 122, 124 reached a temperature of approximately 140° F. after about 35 seconds. Continuing to direct the high temperature air from the hairdryer for another 35 seconds did not further elevate/raise the temperature of the hairbrush, i.e., the conventional hairbrush 100 still only reached a temperature of approximately 140° F.

Tests indicated that the thermal coating of the hairbrush 200 accelerated the speed at which the brush head 204 achieved the top temperature of the dryer. For example, brushes without the thermal coating and that included captive ends were exposed to high velocity, high temperature airflow (approximately 200° F.) and reached the peak temperature of about 200° F. in approximately 27 seconds.

When the thermal coating and the captive ends were used together, the peak temperature of approximately 200° F. was reached in 18 seconds. It is believed that the captive ends create a foiling effect on the brush allowing the air and heat to distribute over a larger surface. That is, the captive ends appear to focus the air between the upturned ends/captive ends of the brush head.

It was also found that a single coating potentially became unworkable because of the lack of durability. However, applying a second coating addressed the durability issue and did not adversely impact the temperature characteristics, i.e., the hairbrush of FIG. 2 achieved the top temperature of 200° F. in approximately 18 seconds as noted above.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

It is claimed:

1. A hairbrush comprising:

a handle;

a brush head extending from the handle having an outer surface with openings formed therein, at least the outer surface of the brush head including a coating that thermally reflects heat wherein the coating is formed at least in part of approximately 10% aluminum paste, the brush head including captive ends at opposite ends of a central portion, the captive ends having a larger cross-sectional dimension than the central portion and shaped to direct airflow from an associated hair dryer toward the central portion of the brush head; and bristles extending through the openings in the outer surface of the brush head.

2. The hairbrush of claim 1 wherein the central portion has a concave configuration wherein the outer surface reduces in cross-sectional dimension from each of the captive ends toward a mid-point of the brush head between the captive ends.

3. The hairbrush of claim 2 wherein the handle and the brush head are formed at least in part from different materials.

4. The hairbrush of claim 1 wherein the reflective coating includes at least one layer.

5. The hairbrush of claim 4 wherein the reflective coating includes at least first and second layers.

6. The hairbrush of claim 1 wherein the hair brush head includes a substrate formed from one of wood, metal, or a plastic composition.

7. The hairbrush of claim 1 wherein the coating is applied to the central portion and captive ends of the brush head.

8. The hairbrush of claim 1 wherein the coating is only applied to the central portion and captive ends of the brush head.

9. A hairbrush comprising:

a handle;

a brush head extending from the handle having an outer surface with openings formed therein, at least the outer surface of the brush head including a thermally reflective coating applied thereto wherein the reflective coating includes approximately 10% aluminum paste, and approximately 75% acrylic acid polymers, and approximately 15% butyl acetate; and bristles extending through the openings in the outer surface of the brush head.

10. A hairbrush comprising:

a handle;

a brush head extending from the handle having captive ends at opposite ends of a central, concave portion, an outer surface of the brush head including a thermally reflective coating applied thereto wherein the reflective coating is formed at least in part of about 10% aluminum paste, for thermally reflecting heat, wherein the heat reflecting coating further includes approximately 75% acrylic acid polymers and approximately 15% butyl acetate; and bristles extending outwardly from the outer surface of the brush head.

* * * * *